United States Patent [19]

Kallioinen

[11] Patent Number: 4,612,113

[45] Date of Patent: Sep. 16, 1986

[54] REPEATING FLOTATION MACHINE

[75] Inventor: Jouko O. Kallioinen, Outokumpu, Finland

[73] Assignee: Outokumpu Oy, Helsinki, Finland

[21] Appl. No.: 684,747

[22] Filed: Dec. 20, 1984

[30] Foreign Application Priority Data

Dec. 29, 1983 [FI] Finland ..... 834846

[51] Int. Cl.[4] ..... B03D 1/16; B03D 1/24

[52] U.S. Cl. ..... 209/170; 209/169; 210/221.1; 210/221.2; 210/256; 55/87; 55/93

[58] Field of Search ..... 209/168, 169, 170, 164; 210/221.1, 221.2, 256, 319; 261/87, 93

[56] References Cited

U.S. PATENT DOCUMENTS

| | | | |
|---|---|---|---|
| 1,285,061 | 11/1918 | Daman | 210/221.1 X |
| 2,073,148 | 3/1937 | Gayford | 209/168 X |
| 2,406,532 | 8/1946 | Fahrenwald | 209/169 |
| 2,652,924 | 9/1953 | Wunsch | 209/169 |
| 2,901,114 | 8/1959 | Smith et al. | 210/256 X |
| 3,642,617 | 2/1972 | Brink et al. | 209/170 X |
| 3,733,272 | 7/1971 | Burns | 210/221.1 X |
| 3,814,396 | 6/1974 | Di Gregorio | 261/93 |
| 4,231,860 | 11/1980 | Kyznetsov et al. | 209/169 |

*Primary Examiner*—S. Leon Bashore
*Assistant Examiner*—Thomas M. Lithgow
*Attorney, Agent, or Firm*—Dellett, Smith-Hill and Bedell

[57] ABSTRACT

The invention relates to a repeating flotation machine for floating minerals from sludges. The repeating flotation machine comprises a flotation cell (1) and a repeat flotation cell (16) placed therein. Inside each cell there is placed a mixer apparatus composed of a stator-rotor combination (2, 3; 17, 18).

12 Claims, 1 Drawing Figure

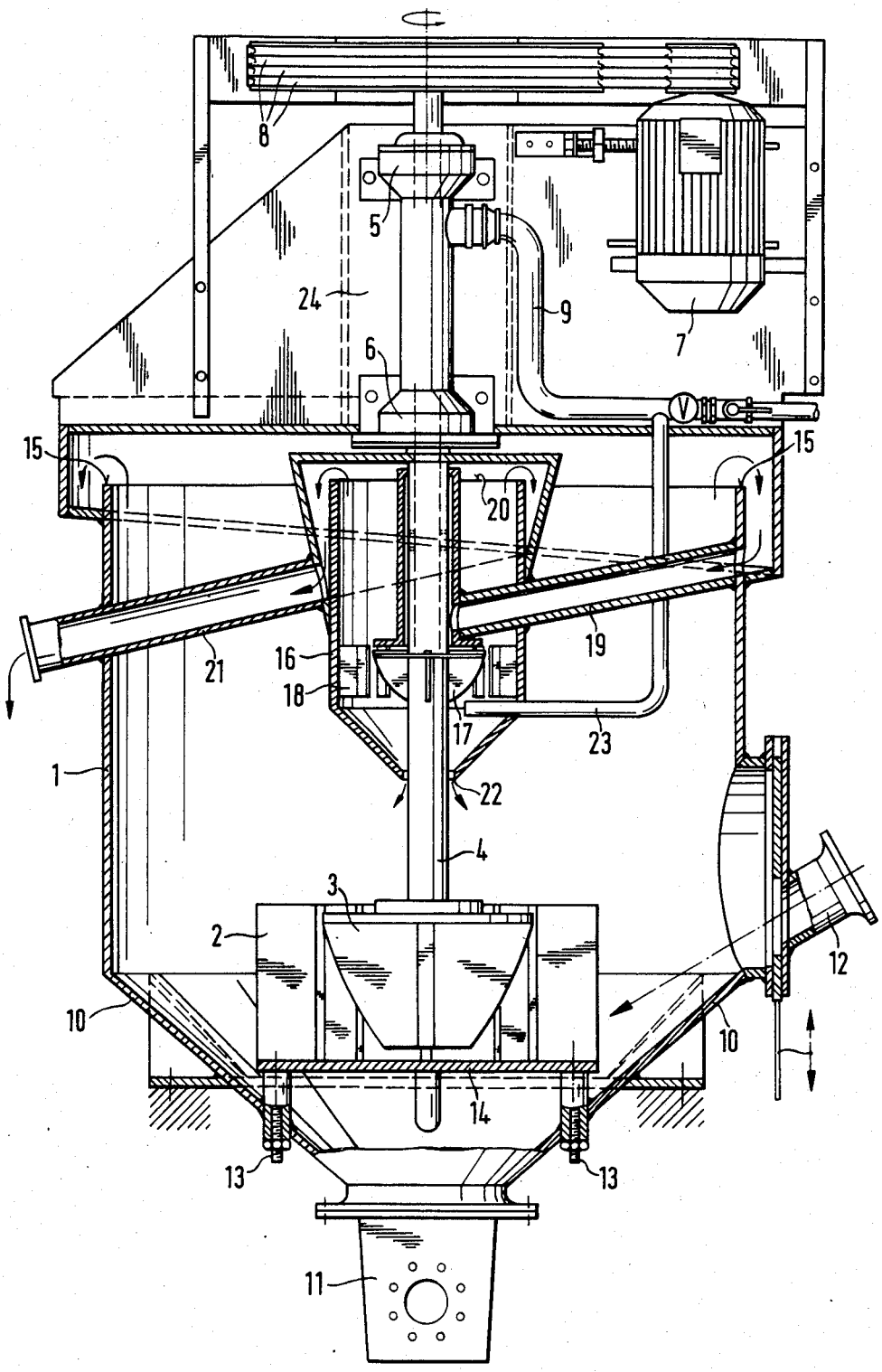
8
5
24
9
7
6
V
15
15
20
19
21
16
18
17
23
1
22
4
3
2
12
10
10
14
13
13
11

REPEATING FLOTATION MACHINE

The present invention relates to a repeating flotation machine for floating minerals or equivalent. The flotation machine consists of a flotation cell and a mixer apparatus fitted therein and comprising actuator means and air inlet means as well as a repeat flotation cell respectively provided with a mixer apparatus and fitted, preferably coaxially, within the primary flotation cell.

The rotor-stator mixer as such is already known in the prior art. Generally known applications are for example the Fagergren mechanism and the OK-mechanism produced by Outokumpu Ltd. The mixer apparatus can be connectd to any prior art flotation cell, such as the Denver unit flotation cell which is described in the work *Mineraalien hienonnus ja rikastus* (Comminution and concentration of Minerals) by R. T. Hukki, Keuruu 1964, p. 391–393.

In most cases, however, one flotation cell is not enough, but several cells are needed; in that case the waste of a given cell usually forms the feed of the next cell. Such a cell assembly is described in the said work, p. 393–394. This cell assembly is called the Denver Standard cell assembly, and it is formed of two or more connected Denver unit flotation cells. Usually the Standard cell assembly contains an even number of cells, because one motor is used to rotate two mixers.

The flotation machines of the Standard cell assembly type take up a lot of floor area in the concentration plant and require large pipework systems. The present invention introduces a new repeat flotation cell where the smaller innermost cell functions as the repeating flotation cell for the concentrate received from the larger cell. In that case the pipework systems are simple and the repeating cell does not take up any additional floor space. Among other advantages of the invention can be mentioned that the apparatus needs only one surface regulating assembly, which is located within the larger cell, and the mixers of both cells are preferably adjusted coaxially. Moreover, by placing the repeating cell in this fashion it is possible to utilize the space around the axis, which otherwise remains useless as regards the flotation process. The characteristic novel features of the invention are listed in the patent claim 1.

The repeat flotation machine of the invention is particularly suited for such flotation processes where the feed has a low valuable mineral content, i.e. the amount of the rough concentrate is small compared to the whole feed amount. The repeat flotation machine is also suited for coarse flotation, where a high quality for the recovered coarse concentrate can be ascertained by means of repetition.

In the following the invention is explained in more detail with reference to the appended drawing, the single FIGURE of which is an illustration of one preferred embodiment of the invention in side cross-section view.

Inside the flotation cell 1 there is fitted the mixer mechanism comprising the stator 2 and the rotor 3. The rotor 3 is attached to the hollow axis 4, which is adjusted with bearings 5, 6 to the supporting structures of the cell. The electric motor 7 rotates the axis 4 by means of the cone belts 8. Air is conducted into the rotor 3 through the hollow axis 4. The air inlet pipe is marked with the reference number 9. When the rotor is rotated, liquid is drawn into the rotor by suction and is impelled outwards, between the blades of the stator 2, into a washing zone that surrounds the mixer.

The whole bottom of the cell forms the cone 10. At the bottom of the cone there is made an opening provided with the pipe connection 11, which pipe is used to discharge the waste from the cell. The feed inlet pipe 12 is fitted to the side wall of the flotation cell at the bottom part of the cell and is at substantially the same height as the rotor 3 so that the sludge coming in through the pipe directly enters the washing zone of the stream flowing from between the blades of the stator 2 and is washed against liquid impelled into the washing zone by the rotor. The position of the feed inlet pipe 12 can be adjusted in the vertical direction. The mixer 2, 3 is disposed at least partially below the side wall, in the space that is bounded laterally by the bottom wall 10.

The stator 2 is attached with the bolts 13 onto the bottom of the cell so that between the cell bottom and the stator bottom there remains a clear cross-gap, which in practice means several centimeters. The stator 2 is provided with a solid bottom plate 14. While the feed flows against the flow coming from the rotor and the stator, the solid particles are classified so that the floatable light particles are suspended, whereas the coarser and heavier sink directly onto the bottom of the cell. When the stator is placed apart from the bottom, the coarse particles have a free access to slide down below the stator and further to be discharged through the pipe 11. The bottom plate 14 attached under the stator prevents the coarse particles from rising up to the suction area of the rotor, which means that the unnecessary and wearing circulation of the coarse material within the cell is prevented.

The coarse concentrate is discharged out of the flotation cell 1 over the discharge lip 15, wherefrom it is conducted into the smaller repeat flotation cell 16, which is located within the flotation cell 1. The flotation mechanism of the repeat flotation cell is formed, in similar fashion as in the large cell, of the rotor 17 and the stator 18. The rotor is preferably attached to the mixer axis 4 of the larger cell. The concentrate received from the large flotation cell in the form of overflow is conducted along the concentrate inlet pipe 19, which is installed under the discharge lip, and extends towards the axis 4 so that the concentrate is discharged close to the repeat cell rotor 17 preferably on top of the rotor and the flow of concentrate is assisted by suction from the rotor 17. The repeated concentrate 20 is discharged from the repeat cell along the discharge pipe 21 which runs through the larger cell. The repeat waste is returned into the larger cell by hydrostatic pressure through the opening 22 between the funnel-shaped cell bottom and the axis.

The flotation air of the repeat cell mixer is conducted along a special air pipe 23 that opens below the rotor 17. The repeat cell is attached to the bearing support 24 of the mixer 2,3.

According to the drawing, the repeat cell mixer uses the same axis and actuator apparatus as the mixer of the large flotation cell. If the volume of the repeat cell is about 1/10 of the volume of the large cell, the diameter of the repeat cell rotor is preferably 60–80% of the diameter of the rotor of the large cell. Naturally the repeat flotation cell can be placed within the large flotation cell in some other than coaxial fashion, but the coaxial arrangement seems best in practice as regards the flotation process of the large cell. Particularly in the case of large flotation cells, it is possible that vortexes are created and the whole material of sludge and froth starts to circle; all of these harmful phenomena can be prevented by employing the repeat flotation cell installed within the larger cell.

The rotor and stator structures, for instance, have not been explained in detail in the above specification. This is due to the fact that the invention is not strictly limited to any specific rotor-stator type. Apparently the best practical results are achieved by employing machinery manufactured by Outokumpu Ltd. and sold under the trade mark OK.

In the above specification, the invention has been described with reference to one preferred embodiment only. It is natural that the invention can be largely modified within the scope of the appended patent claims.

I claim:

1. A repeating flotation machine for separating minerals and the like from sludge by flotation, comprising a primary flotation cell and a repeat flotation cell, each flotation cell containing a mixer comprising a rotor and a stator, and each having a waste material output and a concentrate output, the repeat cell also having a feed material input connected to the concentrate output of the primary cell and the primary cell also having a feed material input connected to the waste material output of the repeat cell, the repeat cell being located within the primary cell.

2. A machine according to claim 1, wherein the primary cell and the repeat cell are each generally cylindrical in form, and the repeat cell is located substantially coaxially within the primary cell, and the machine comprises a rotor drive shaft extending axially within the repeat cell and the primary cell, and wherein the rotors of the two cells are each connected to the rotor drive shaft.

3. A machine according to claim 1, wherein the primary cell has a discharge lip over which concentrate flows from the primary cell to the concentrate output thereof, and the feed material input of the repeat cell is positioned to deliver feed material into a region that is above the rotor of the repeat cell and close to the axis of rotation of the rotor of the repeat cell.

4. A machine according to claim 1, wherein the concentrate output of the repeat cell is connected to a concentrate output pipe which extends through the primary cell.

5. A machine according to claim 1, wherein each flotation cell has associated therewith means for introducing air into the material being treated in the cell, the means associated with the repeat cell comprising an air inlet pipe that opens into the repeat cell at a location beneath the rotor of the repeat cell.

6. A machine according to claim 1, wherein the repeat cell has a funnel-like bottom wall defining an opening, and the machine comprises a rotor drive shaft that extends downwardly through the repeat cell and passes through said opening with clearance and is connected to the rotor of the primary cell, the clearance between the rotor drive shaft and the bottom wall of the repeat cell constituting the waste material output of the repeat cell and a feed material input of the primary cell.

7. A machine according to claim 1, comprising a rotor drive shaft connected to the rotor of the primary cell, and a bearing support structure for the rotor drive shaft, and wherein the repeat cell is secured to said bearing support structure.

8. A machine according to claim 1, wherein the primary flotation cell has a bottom wall, and the mixer of the primary cell includes a substantially imperforate plate that is disposed beneath the rotor of the primary cell and is spaced from the bottom wall of the primary cell, and wherein at least one feed material input of the primary cell is positioned to direct feed material towards the mixer of the primary cell.

9. A machine according to claim 1, comprising a rotor drive shaft that is disposed on a substantially vertical axis and is connected to the rotor of the primary flotation cell, and wherein the mixer of the primary flotation cell comprises a substantially imperforate bottom plate located beneath its rotor and is surrounded in the flotation cell by a washing zone into which liquid that enters the mixer is impelled by rotation of the rotor, the primary flotation cell has a bottom wall that converges downwards towards said vertical axis, the waste material output of the primary flotation cell is formed in the bottom wall and is disposed substantially on said vertical axis, and the primary flotation cell has a second feed material input which is disposed at substantially the same height as the rotor of the primary flotation cell and is arranged to introduce sludge into the washing zone at a location that is spaced laterally from the mixer of the primary flotation cell, whereby the sludge is washed against liquid impelled into the washing zone by the rotor and coarse particles in the sludge accordingly fall to the bottom wall and pass under the bottom plate towards the waste material output of the primary flotation cell.

10. A machine according to claim 9, wherein the primary flotation cell has a side wall that is substantially vertical and the second feed material input of the primary flotation cell is disposed at the bottom of said side wall.

11. A machine according to claim 1, wherein the primary flotation cell has a side wall that is substantially vertical and a bottom wall that converges downwards, and the mixer of the primary flotation cell is disposed at least partially within a space that is bounded laterally by the bottom wall.

12. A machine according to claim 11, wherein the primary flotation cell has a second feed material input that is disposed at substantially the same height as the rotor of the primary flotation cell.

* * * * *